United States Patent [19]

Rissi

[11] 4,346,847

[45] Aug. 31, 1982

[54] ELECTROMAGNETIC FUEL INJECTOR WITH ADJUSTABLE ARMATURE SPRING

[75] Inventor: Paul Rissi, Grand Rapids, Mich.

[73] Assignee: General Motors Corporation, Detroit, Mich.

[21] Appl. No.: 170,734

[22] Filed: Jul. 21, 1980

[51] Int. Cl.[3] ..... F02M 51/06

[52] U.S. Cl. ..... 239/585; 251/129; 267/177

[58] Field of Search ..... 239/585; 251/129, 141; 267/175, 177

[56] References Cited

U.S. PATENT DOCUMENTS

| | | | |
|---|---|---|---|
| 2,980,090 | 4/1961 | Sutton et al. | 123/119 |
| 3,653,630 | 4/1972 | Ritsema | 251/129 |
| 3,662,987 | 5/1972 | Schlagmuller et al. | 251/139 |
| 3,738,578 | 6/1973 | Farrell | 239/585 |
| 4,008,876 | 2/1977 | Bastle | 251/129 |
| 4,156,506 | 5/1979 | Locke et al. | 239/585 |
| 4,218,021 | 8/1980 | Palma | 239/585 |
| 4,247,052 | 1/1981 | Gray | 239/585 |

FOREIGN PATENT DOCUMENTS

| | | | |
|---|---|---|---|
| 4931 | 11/1905 | France | 267/177 |

*Primary Examiner*—Andres Kashnikow

*Attorney, Agent, or Firm*—Arthur N. Krein

[57] ABSTRACT

An electromagnetic fuel injector has an axially fixed guide pin for axial alignment of a spring biased, movable armature. The guide pin has an abutment shoulder thereon for engagement with a surface of the armature whereby to serve as an abutment stop so as to establish a predetermined minimum working air gap between the opposed working surfaces of the armature and an associated solenoid pole. A spring seat nut is threaded onto external threads provided on the guide pin to serve as an abutment for one end of the armature spring. This nut is provided with non-circular conformations extending radially outward thereof which are slidably received in axially orientated slots in the solenoid pole to prevent rotation of the nut relative thereto. The guide pin is provided with an externally accessible driver-receiving head whereby it can be rotated to effect axial displacement of the spring seat nut whereby to adjust the force of the armature spring.

2 Claims, 2 Drawing Figures

ELECTROMAGNETIC FUEL INJECTOR WITH ADJUSTABLE ARMATURE SPRING

FIELD OF THE INVENTION

This invention relates to electromagnetic fuel injectors and, in particular, to such type injectors with means therein providing a minimum fixed air gap and adjustability of the armature spring load.

DESCRIPTION OF THE PRIOR ART

Electromagnetic fuel injectors are used in the fuel injection systems for vehicle engines because of the capability of this type injector to more effectively control the discharge of a precise metered quantity of fuel per unit of time to an engine. Such electromagnetic fuel injectors, as used in vehicle engines, are normally calibrated so as to inject a predetermined quantity of fuel per unit of time prior to their installation in the fuel system for a particular engine.

In one such type electromagnetic fuel injector, presently in use on commercially available passenger vehicles, a two-part valve means movable relative to an annular valve seat is used to open and close a passage for the delivery of fuel from the injector out through an injection nozzle having delivery orifices downstream of the valve seat. One part of this valve means is a sphere-like valve member having a flat on one side thereof and being spherical opposite the flat to provide a spherical seating surface for valve closing engagement with the valve seat. The other part of the valve means is an armature with a flat end face seated against the flat surface of the valve member in a laterally slidable engagement therewith.

In this type injector, the armature is provided with an axial through guide bore to slidably receive a fixed, axially extending guide pin. An armature spring is positioned within the injector to normally bias the armature in a direction to effect seating of the valve member against the valve seat. A fixed minimum air gap may be provided for in this type injector by the use of a thin shim of non-magnetic material fastened to the pole piece face so as to provide the necessary gap between the armature and the solenoid pole piece when the injector is open. Alternatively, as disclosed in co-pending U.S. patent application Ser. No. 082,893, entitled "Electromagnetic Fuel Injector" filed Oct. 9, 1979 in the name of Leo A. Gray now U.S. Pat. No. 4,247,052 and assigned to a common assignee, a fixed minimum air gap may be provided for in this type injector by the use of a stepped guide pin provided with a shoulder for abutment against a portion of the armature whereby to limit movement of the armature relative to the solenoid pole piece.

Also in this type injector, the injection nozzle is axially adjustable in the body of the injector whereby the annular valve seat can be moved axially while the injector is flowing calibration fluid on a continuous basis therethrough until the desired flow rate is achieved, thus establishing the stroke length of the armature/-valve for that injector.

Although during such calibration, the flow rate of each injector can be properly calibrated, unfortunately the axial displacement of the injector nozzle during such calibration will cause a corresponding change in the armature spring force, depending on the axial extent of movement of the injector nozzle.

As will be apparent, any change in the armature spring force will effect the dynamic response of the armature upon energization of its associated solenoid and, accordingly, effect the output of the injector.

SUMMARY OF THE INVENTION

A primary object of the present invention is to provide an improved electromagnetic fuel injector construction that advantageously utilizes a shouldered guide pin for axial alignment of a movable armature and to provide an abutment for limiting axial movement of the armature in one direction so as to establish a predetermined minimum working air gap between the opposed surfaces of the armature and the pole piece of its associated solenoid coil, the guide pin being provided with external threads adjustably receiving a spring retainer nut against which one end of the armature spring abuts and which is fixed against rotation relative to the pole piece, the guide pin also having an externally accessible driver-receiving head to permit manual rotation of the guide pin relative to the spring retaining nut.

Another object of the invention is to provide an improved solenoid structure for use in an electromagnetic fuel injector of the type having an injector nozzle assembly with a valve seat that can be axially positioned to obtain a desired fuel discharge rate, wherein the solenoid pole is provided with a shouldered guide pin axially fixed thereto to serve as a guide for axial movement of an armature and as a stop to limit movement of the armature in one axial direction towards the solenoid pole, the guide pin being rotatable by external means and provided with a spring abutment nut threaded thereon against which one end of an armature biasing spring abuts, means being provided on the spring abutment nut to prevent its rotation relative to the solenoid pole.

Still another object of the present invention is to provide an electromagnetic fuel injector of the above type which includes features of solenoid construction, operation and arrangement, rendering it easy and inexpensive to manufacture and to calibrate both for the desired fuel flow and for dynamic response, which is reliable in operation, and in other respects suitable for extended use on production motor vehicle fuel systems.

The present invention relates to an electromagnetic fuel injector of the type having an axially adjustable nozzle assembly therein, with this nozzle assembly providing an annular valve seat cooperating with a movable valve member defined by a spherical valve element having a flat face on one side thereof which is seated on the flat end face of an armature but which can slide sideways to accommodate misalignment. The armature is spring biased towards a valve closed position and is drawn towards the pole piece against the bias of a spring by current flow in the solenoid coil. The armature is guided by a small diameter guide pin for axial movement, the guide pin being axially fixed in a solenoid pole piece. The armature, under the spring bias, locates the valve element in a closed, centered position on the valve seat. The guide pin is provided with a shoulder to provide a stop for the armature in the direction of its travel towards its associated solenoid pole piece so as to provide a minimum air gap between the opposed working surfaces of the solenoid pole piece and armature. The guide pin, in accordance with the invention, is also provided with external threads to threadedly receive a spring abutment nut against which one end of the armature spring abuts. In a preferred embodiment, the spring abutment nut is provided with non-circular conformations extending radially outward thereof slidably received in slots provided in the pole piece to prevent its rotation relative to the pole piece. The guide pin is also provided with an externally accessible driver-receiving head to permit manual rotation of the guide pin relative to the spring retaining nut whereby to effect the desired axial displacement of the spring retaining nut so as to vary the armature spring load, as desired, for the desired dynamic response of the armature upon energization of the solenoid coil.

For a better understanding of the invention, as well as other objects and further features thereof, reference is had to the following detailed description of the invention to be read in connection with the accompanying drawings.

DESCRIPTION OF A PREFERRED EMBODIMENT

Figure 1:
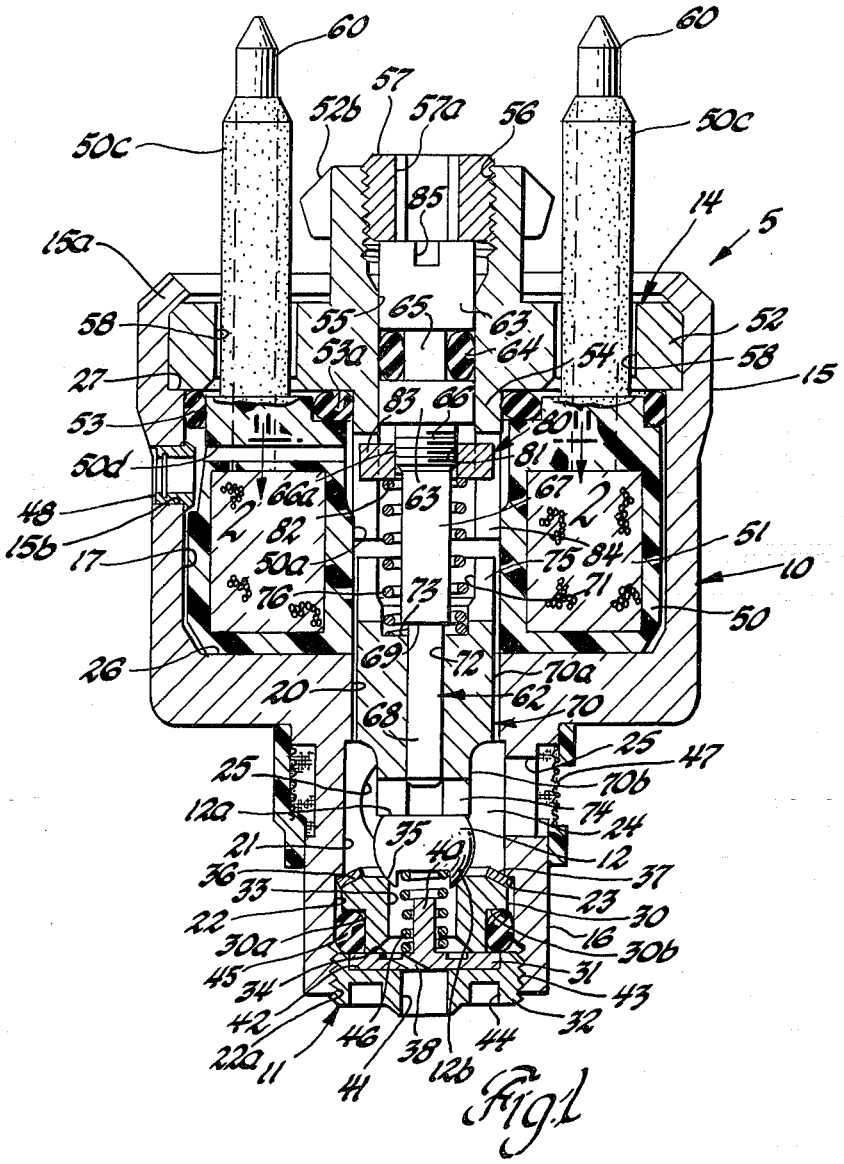
FIG. 1 is an enlarged longitudinal, cross-sectional view of an exemplary embodiment of an electromagnetic fuel injector having a solenoid structure in accordance with the invention incorporated therein, the armature guide pin, valve member and lead portion of the solenoid bobbin of the assembly being shown in elevation; and, FIG. 2 is a cross-sectional view of the electromagnetic fuel injector of FIG. 1 taken along line 2—2 of that Figure to show details of the spring retaining nut and solenoid pole piece of the assembly.

Referring now to FIG. 1, an electromagnetic fuel injector, generally designated 5, constructed in accordance with a preferred embodiment of the invention, includes a body 10, a nozzle assembly 11, a valve member 12 and a solenoid assembly 14 as major components thereof.

In the construction illustrated, the body 10, made for example of silicon core iron, is of circular hollow tubular configuration and is of such external shape so as to permit direct insertion, if desired, of the injector into a socket provided for this purpose in either an intake manifold, not shown, or in an injector mechanism of a throttle body injection apparatus, not shown, for an engine.

The body 10, includes an enlarged upper solenoid case portion 15 and a lower end nozzle case portion 16 of reduced external diameter relative to portion 15. An internal cylindrical cavity 17 is formed in the body 10 by a stepped vertical bore therethrough that is substantially co-axial with the axis of the body. In the construction shown, the stepped bore in body 10 provides cylindrical upper and lower intermediate walls 20 and 21, respectively, and a cylindrical lower wall 22. Wall 20 is of an internal diameter so as to loosely slidably receive the large diameter end of an armature 70, to be described, while wall 21 is of greater diameter than wall 20 but of smaller diameter than lower wall 22. Walls 21 and 22, in the embodiment illustrated, are interconnected by a flat shoulder 23.

Lower intermediate wall 21 defines the outer peripheral extent of a fuel chamber 24 within the body 10. In addition, the body 10 is provided with a plurality of circumferentially equally spaced apart, radial port passages 25 in the nozzle case portion 16 thereof which open through the wall 21 to effect flow communication with the fuel chamber 24. Preferably three such passages are used in the preferred embodiment of the injector illustrated.

The injection nozzle assembly 11 mounted in the lower nozzle case portion 16 of body 10 includes, in succession starting from the upper end with reference to FIG. 1, a seat element 30, a swirl director plate 31 and a spray tip 32. The seat element 30, director plate 31 and spray tip 32 are stacked face to face and are positioned in the lower cavity formed by the cylindrical wall 22 in the lower nozzle case portion 16 in a manner to be described.

In the embodiment shown, the seat element 30 is provided with a central axial discharge passage 33 therethrough, this passage being tapered outward at its lower end whereby its outlet end diameter is substantially equal to or greater than the outside diameter of the annular groove 34 provided in the upper surface of the swirl director plate 31. The seat element 30 is also provided with an annular, conical valve seat 35 on its upper surface 36, the valve seat being formed concentric with and encircling the upper end of the discharge passage 33. The upper surface 36 of the seat element 30, in the embodiment illustrated, is downwardly tapered adjacent to its outer peripheral edge formed at a suitable angle from the horizontal so as to provide an abutment shoulder for the outer peripheral annular edge on one side of an abutment washer 37, for a purpose to be described.

The swirl director plate 31 is provided with a plurality of circumferentially, equally spaced apart, inclined and axially extending director passages 38. Preferably, six such passages are used, although only one such passage is shown in FIG. 1. These director passages 38, of predetermined equal diameters, extend at one end downward from the annular groove 34 provided on the upper surface of the swirl director plate 31. The groove 34, as shown, is positioned so as to encircle a boss 40 formed integral with the director plate 31 to extend vertically upward from the upper surface of the main body portion thereof. The boss 40 thus extends vertically upward loosely into the discharge passage 33 so as to terminate at a predetermined location, a location that is axially spaced from the lower end of the valve member 12 when it is in its seated position shown.

The spray tip 32 is provided with a straight through passage 41 which serves as a combined swirl chamber-discharge passage for the discharge of fuel from this nozzle assembly. As shown the spray tip 32 is provided at its upper end with a recessed circular groove 42 of a size so as to receive the main body portion of the swirl director plate 31 therein whereby to locate this element substantially co-axial with the axis of the swirl chamber-discharge passage 41.

In the construction shown, the outer peripheral surface of the spray tip 32 is provided with external threads 43 for mating engagement with the internal threads **22*a* of lower wall in the lower end of the body 10. Preferably the threads 22*a* and 43 are of suitable fine pitch whereby to limit the axial movement of the spray tip, a predetermined extent as desired, for each full revolution of the spray tip relative to body 10. The lower face of the spray tip 32 is provided, for example, with at least a pair of diametrically opposed blind bores 44 of a size so as to slidably receive the lugs of a spanner wrench, not shown, whereby rotational torque may be applied to the spray tip 32 during assembly and axial adjustment of this element in the body 10**.

With the structural arrangement shown, the stroke of the injector can be accurately adjusted by the use of a collapsible abutment member between the upper surface of the valve seat element 30 and the shoulder 23 of the body 10. The collapsible abutment member, in the construction shown, is in the form of a flat spring abutment washer 37 of a suitable outside diameter to be slidably received within the lower wall 22 so as to abut against shoulder 23 located a predetermined axial distance from the lower flat end of the core of the solenoid assembly to be described hereinafter. The washer 37 when first installed would be flat. As thus assembled, the upper outer peripheral edge of the washer 37 would engage against the outer radial portion of the shoulder 23 and its radial inner edge on the opposite side of the washer would abut against the upper tapered surface 36 of the seat element 30. With the washer 37, seat element 30, swirl director plate 31, and the spray tip 32 thus assembled and with the spray tip 32 in threaded engagement with internal threads 22*a*, these elements can then be axially adjustably positioned upward within the lower end of the body 10.

After these elements are thus assembled, actual adjustment of the injector stroke is made while the injector is flowing calibration fluid on a continuous basis therethrough. During flow of the calibration fluid, an operator, through the use of a spanner wrench, not shown, can rotate the spray tip 32 in a direction whereby to effect axial displacement thereof in an upward direction with reference to FIG. 1. As the nozzle assembly is moved axially upward by rotation of the spray tip 32, the seat element 30 thus moved would cause the abutment washer 37 to deflect or bend into a truncated cone shape, as shown in FIG. 1, to thereby in effect forcibly move the lower abutment surface of the washer 37 upward relative to the fixed shoulder 23 until the desired flow rate is achieved, thus establishing the correct axial position of the valve seat 35 on seat element 30. This thus establishes the proper stroke length of the armature/valve for that injector. The spray tip 32 is then secured against rotation relative to the body 10 by any suitable means such as, for example, by laser beam welding at the threaded interface of these elements.

With the above described arrangement, the effective flow orifice of the valve and valve seat interface, as generated by length of injector stroke, is controlled directly within very close tolerances by an actual flow measurement rather than by a mechanical displacement gauge measurement.

An O-ring seal 45 is operatively positioned to effect a seal between the seat element 30 and the wall 22. In the construction shown in FIG. 1, the seat element 30 is provided with an external reduced diameter wall 30*a* at its lower end to receive the O-ring seal 45. The ring seal 45 is retained axially in one direction by the flat shoulder 30*b* of the seat element 30 and in the opposite direction by its abutment against the upper surface of director plate 31.

Flow through the discharge passage 33 in seat element 30 is controlled by the valve 12 which is loosely received within the fuel chamber 24. This valve member is movable vertically between a closed positioned at which it is seated against the valve seat 35 and an open position at which it is unseated, from the valve seat 35, as described in greater detail hereinafter. In the construction illustrated, the valve 12 is of a truncated ball-like configuration to provide a semi-spherical seating surface for engagement against the valve seat 35. As shown in FIG. 1, the valve 12 is made in the form of a ball which is truncated at one end whereby to provide a flat surface 12*a* on its upper side for a purpose to be described, the lower seating surface portion 12*b* thereof being of semi-spherical configuration whereby to be self-centering when engaging the conical valve seat 35.

In the construction shown, a valve spring 46, of predetermined force is used to aid in unseating of the valve 12 from the valve seat 35 and to hold this valve in abutment against the lower end of its associated armature when in its open position during periods of injection. As shown, the compression valve spring 46 is positioned on the lower side of the valve 12 so as to be loosely received in the discharge passage 33 of seat element 30. The valve spring 46 is thus positioned to abut at one end, its lower end with reference to FIG. 1, against the upper surface of director plate 31 and to abut at its opposite end against the lower semi-spherical portion of valve 12 opposite the flat surface 12*a*. Normal seating and actuation of the valve 12 is controlled by the armature 70 of solenoid assembly 14, in a manner to be described.

To effect filtering of the fuel being supplied to the injector 5 prior to its entry into the fuel chamber 24, there is provided a fuel filter assembly, generally designated 47. The fuel filter assembly 47 is adapted to be suitably secured, as for example by predetermined press fit, to the body 10 in position to encircle the radial port passages 25 therethrough.

The solenoid assembly 14 of the injector 5 includes a tubular coil bobbin 50 supporting a wound wire solenoid coil 51. Bobbin 50 is positioned in the body 10 between an internal flat shoulder 26 thereof and the lower surface of a circular pole piece 52 that is slidably received at its outer peripheral edge within an enlarged upper wall portion of body 10. Pole piece 52 is axially retained within body 10, as by being sandwiched between an internal flat shoulder 27 and the radially inward spun over upper rim 15*a* of the body. Annular seals 53 and 53*a* are used to effect a seal between the body 10 and the upper, outer peripheral end of bobbin 50 and between the upper end of bobbin 50 and the lower surface of pole piece 52, respectively. A fuel filter plug assembly 48 suitably secured in a radial port 15*b* provided in the solenoid case portion 15 of body 10 is used for the return of fuel flowing from fuel chamber 24 upward into and around bobbin 50. A radial passage 50*d* in bobbin 50 interconnects bore 50*a* with the annular space between the interior wall of body 10 and the outer peripheral surface of the coil bobbin 50.

Formed integral with the pole piece 52 and extending centrally downward therefrom is a tubular pole 54. Pole 54 is of a suitable external diameter so as to be slidably received in the bore aperture 50*a* that extends coaxially through the bobbin 50. The pole 54, as formed integral with the pole piece 52, is of a predetermined axial extent so as to extend a predetermined axial distance into the bobbin 50 in axial spaced apart relation to the shoulder 27. The pole piece 52, in the construction illustrated, is also provided with an upstanding central boss 52*b* that is radially enlarged at its upper end for a purpose which will become apparent.

Pole piece 52 and its integral pole 54 are formed with a central through stepped bore 55. The cylindrical annular wall, defined by the bore 55 is provided at its upper enlarged diameter end, within the enlarged portion of boss 52*b*, with internal thread 56. An abutment stop, in the form of an adjustable abutment screw 57, having a tool receiving slot 57*a* extending therethrough for a purpose to be described hereinafter, is adjustably threadedly received by the thread 56.

Pole piece 52 is also provided with a pair of diametrically opposed circular through slots 58 located radially outward of boss 52*b* so as to receive the upright circular studs 50*c* of bobbin 50. Each such stud 50*c* has one end of a terminal lead 60 extending axially therethrough for connection to a suitable controlled source of electrical power, as desired. The opposite end, not shown, of each such lead 60 is connected (not shown), as by solder, to a terminal end of coil 51.

Now, in accordance with the invention, a guide pin 62 for the armature 70, is fixed against axial movement with respect to the body 10 but is adapted for manual rotation by external means, not shown, for a purpose to be described. The cylindrical armature guide pin 62, made of suitable non-magnetic material, is provided with axially spaced apart enlarged diameter upper end portions whereby to define axially spaced apart cylindrical lands 63 that are of a diameter whereby they are guidingly received in bore 55 of the pole piece 52 so as to effect coaxial alignment of the armature guide pin 62 within this bore and thus within the body 10. The enlarged, upper end of the armature guide pin 62 is positioned so as to abut against the lower surface of the abutment screw 57.

A suitable seal, such as an O' ring seal 64, is sealingly engaged against a wall portion of the pole piece 52 defining bore 55 and a reduced diameter portion 65 of the armature guide pin 62 between the lands 63.

In accordance with a feature of the subject invention, the guide pin 62, in the construction of the preferred embodiment shown, is provided at its opposite end, lower end with reference to FIG. 1, with a stepped external diameter portions that includes an upper portion 66, provided with external threads 66*a*, an intermediate stop member portion 67 and a lower free end guide stem 68. Upper portion 66, stop member portion 67 and guide stem 68 are of progressively reduced outside diameters relative to the lands 63. Stop member portion 67 is connected to guide stem 68 by a radial flat abutment shoulder 69 which is of sufficient area to serve as an abutment stop for the armature 70 to be described. In addition, the guide stem 68 is of a predetermined outside diameter to serve as a guide for axial up and down movement of the armature 70.

The axial extent of stop member portion 67 and therefore the axial location of shoulder 69 is preselected so that shoulder 69 can serve as an abutment stop for the armature 70, to be described, whereby upward movement of the armature 70 toward the lower flat end of pole 54 can be stopped at a predetermined axial position so that a minimum fixed working air gap can be maintained between the upper end of the armature 70 and the lower end surface of pole 54.

The armature 70 of the solenoid assembly 14 is of a cylindrical tubular construction with an upper portion 70*a* of an outside diameter whereby this armature is loosely slidably received within the intermediate wall 20 of the body 10 and in the lower guide portion of the bore aperture 50*a* of bobbin 50 and a lower reduced diameter portion 70*b*. The armature 70 is formed with a stepped central bore therethrough to provide an upper spring cavity portion defined by an internal cylindrical upper wall 71 of a suitable predetermined inside diameter and a lower cylindrical pin guide bore wall 72 portion of a preselected smaller inside diameter than that of wall 71 and of a size whereby to slidably receive the small diameter guide stem 68 of the armature guide pin 62. As previously described, the armature 70 is axially guided for movement relative to pole 54 by the guide stem 68 of armature guide pin 62. As shown, the wall 71 and the guide bore wall 72 of the armature 70 are interconnected by a flat shoulder 73 for a purpose which will become apparent.

The armature 70 at its lower end is provided with a central radial extending through narrow slot 74 formed at right angles to the axis of the armature. At its opposite or upper end, the armature 70 is also provided with at least one right angle, through narrow slot 75.

As shown in FIG. 1, the armature 70 is slidably positioned for vertical axial movement as guided by the guide stem 66 armature guide pin 62 between a lowered position, as shown, at which it abuts against the upper flat surface 12*a* of valve 12 to force the valve into seating engagement with the valve seat 35 and a raised position at which the internal flat wall 73 of the armature 70 abuts against the shoulder 69 of the guide pin 62.

When the armature 70 is in its lowered position, a working air gap is established between the lower end of the pole 54 and the upper end of the armature 70 by axial positioning of the nozzle assembly 11 in the manner described hereinabove. In addition, by positioning the shoulder 69 of the guide pin 62 relative to the end of the pole 54 so that upward movement of the armature 70 is selectively limited, as desired, by its abutment against the shoulder 69 so that the armature does not contact the pole 54, a minimum fixed air gap can be maintained between the upper end of the armature 70 and the lower, free end surface of pole 54. In the embodiment shown in FIG. 1, this minimum working air gap can be preselected and adjusted as desired, by axial movement of the adjustable abutment screw 57.

Armature 70 is normally biased to its lowered position, as shown, with the valve 12 seated against the valve seat 35 by means of a coiled armature return spring 76 which is of a predetermined force value greater than that of the valve spring 46. Spring 76 is positioned in the spring cavity within the armature 70 and in the bore of pole 54. The spring 76 is thus positioned to encircle the stop member portion 67 of the guide pin 62 with one end of the spring positioned to abut against the surface provided by radial shoulder 73 at the bottom of the spring cavity in armature 70.

In accordance with the subject invention, a spring seat nut 80, with an internally threaded bore 81 therethrough, is threadedly engaged by the external threads 66*a* of guide pin 62 whereby the lower annular face 82 of this nut acts as an abutment stop for the opposite end of the armature spring 76.

Figure 2:
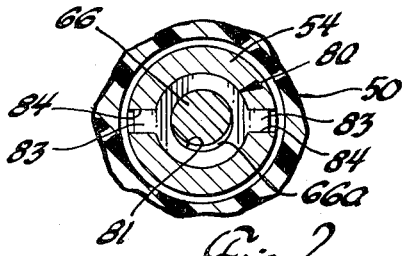

As best seen in FIG. 2, spring seat nut 80 is provided with non-circular radial conformations, such as rectangular radial extensions 83, which are adapted to be slidably received in axially orientated diametrically opposed slots 84 provided for this purpose in the lower end of pole 54 whereby the spring seat nut 80 is restrained against rotation relative to the pole 54 and therefore body 10. As shown in FIG. 1, the slots 84 extend a suitable axial distance upward from the bottom of pole 54 whereby to permit sufficient axial movement of the spring seat nut 80, as necessary, to effect adjustment of the load applied by the armature spring 76 against the armature 70 in a valve closing direction. As will be apparent, the slots 84 are of a suitable width so as to loosely receive the opposed flat sides of the extensions 83 while still preventing rotation of the spring seat nut relative to the pole piece 52 and thus relative to body 10.

As best seen in FIG. 1, the guide pin 62 is provided at its upper end, with reference to FIG. 1, with an externally accessible internal wrenching or driver-receiving head, which in the embodiment illustrated is in the form of a screwdriver slot 85. Thus with the arrangement shown, the guide pin 62 is externally accessible so that it may be manually rotated by a suitable driver, such as a screwdriver not shown, which can be inserted through the tool receiving slot 57*a* in abutment screw 57 whereby, depending on the direction of rotation of the guide pin, the spring seat nut can be moved axially in either an up or down direction.

The above-described structural arrangements allows the minimum air gap to be established by means of the shouldered guide pin 62 as previously described hereinabove and allows the stroke of the armature 70 to be adjusted by axial movement of the nozzle assembly 11 so as to obtain the desired discharge flow rate, as desired, in the manner described hereinabove. After these parameters have been established, the armature spring 76 load can then be adjusted to obtain a desired dynamic response by rotating the guide pin 62 through the use of a suitable tool, such as a screwdriver engaging the screwdriver slot 85 in the top of the guide pin. The through tool receiving slot 57*a* in the abutment screw 57 permits external access to the guide pin for this purpose.

When the guide pin 62 is thus manually rotated, the spring seat nut 80 will move up or down, with reference to FIG. 1, depending on the direction of rotation of the guide pin, thus changing the effective load applied by the spring 76 against the associated armature 70. This allows the dynamic response and therefore the dynamic flow output of the injector to be adjusted as desired for a particular application.

When the guide pin 62 is rotated, only the spring seat nut 80 moves up or down and, since the guide pin is fixed axially by the force of spring 76 effecting its abutment against the abutment screw 57, the original fixed air gap dimension is not disturbed. Accordingly, in accordance with the invention, there is provided a structural arrangement which allows the armature spring load to be adjusted independently of the fixed air gap dimension.

While the invention has been described with reference to a particular embodiment disclosed herein, it is not confined to the details set forth since it is apparent that various modifications can be made by those skilled in the art without departing from the scope of the invention.

For example, a tubular abutment ring, not shown, which may be in the form of a split ring, could be used instead of the adjustable abutment screw 57 to serve as the abutment stop for the guide pin 62.

If such a split tubular abutment ring is used, the bore 55 can be made of continuous uniform internal diameter through the pole piece 52 so that the abutment ring can be press fitted into the upper end of this bore and then fixed, as by welding, to the pole piece whereby it would serve as a fixed abutment stop for the guide pin 62 in a manner similar to the use of an abutment screw 57. Of course such an abutment ring would only be fixed after proper positioning of the guide pin 62 axially within the bore 55 so that its shoulder 69 would be axially positioned whereby to provide a predetermined minimum fixed air gap between the opposed working surfaces of the pole 54 and armature 70, in the manner previously described hereinabove.

Accordingly, this application is therefore intended to cover such modifications or changes as may come within the purposes of the invention as defined by the following claims.

The embodiments of the invention in which an exclusive property or privilege is claimed are defined as follows:

1. An electromagnetic fuel injection valve having a housing with a solenoid pole piece defining a generally cylindrical bore within which an armature is positioned at one end thereof for opening and closing movements to open and close a fuel discharge passage, a spring in said bore effective at one end to bias the armature in a direction to close the fuel discharge passage, adjustable stop elements seating against the other end of said spring, said stop elements including a nut having an annular face in engagement with the spring and noncircular confirmations extending outboard said face, said housing defining axially oriented slots receiving said conformations and restraining the nut against rotation, a guide pin extending axially of and telescoped with said bore, said spring and said armature and threadedly receiving the nut, said guide pin having an externally accessible driver-receiving head, said guide pin further having an abutment shoulder engageable with the armature whereby to fix the extent of armature movement in the spring compressing direction and an abutment screw adjustably threaded in said bore of said housing for abutment against said head of said guide pin whereby to retain said guide pin against axial movement in one direction.

2. An electromagnetic fuel injection valve having a housing means defining a generally cylindrical bore therethrough and terminating at one end in a fuel discharge passage, a pole piece fixed in the opposite end of said bore in said housing, said pole piece having an axial aperture therethrough which is threaded at its outboard end, an armature slidably positioned in said bore for opening and closing movements to open and close said fuel discharge passage, said armature having a guide bore therethrough, a hollow screw adjustably threaded in the opposite end of said bore, a guide pin axially adjustably fixed in said aperture of said pole piece and having a portion thereof extending toward said fuel discharge passage and telescopically received in said guide bore of said armature, a spring in said bore effective at one end to bias the armature in a direction to close said fuel discharge passage and, an adjustable spring seat nut seating against the other end of said spring, said spring seat nut having an annular face in engagement with the spring and noncircular conformations extending outboard said face, said pole piece defining axially oriented slots receiving said conformations for restraining said spring seat nut against rotation relative thereto, said guide pin threadedly receiving said spring seat nut, said guide pin having an externally accessible driver-receiving head in abutment against said screw and, said guide pin further having an abutment shoulder engageable with said armature that is operable to fix the extent of armature movement in the spring compressing direction.

* * * * *